US009140514B2

(12) United States Patent
Ady

(10) Patent No.: US 9,140,514 B2
(45) Date of Patent: Sep. 22, 2015

(54) ARCHERY BOW

(71) Applicant: Daniel Ady, Caldwell, ID (US)

(72) Inventor: Daniel Ady, Caldwell, ID (US)

( * ) Notice: Subject to any disclaimer, the term of this patent is extended or adjusted under 35 U.S.C. 154(b) by 0 days.

(21) Appl. No.: 14/295,313

(22) Filed: Jun. 3, 2014

(65) Prior Publication Data

US 2014/0360478 A1 Dec. 11, 2014

Related U.S. Application Data

(60) Provisional application No. 61/833,054, filed on Jun. 10, 2013.

(51) Int. Cl.

| | |
|---|---|
| ***F41B 5/00*** | (2006.01) |
| ***F41B 5/14*** | (2006.01) |
| ***F41B 5/10*** | (2006.01) |
| ***F41G 1/467*** | (2006.01) |

(52) U.S. Cl.
CPC ..... *F41B 5/1403* (2013.01); *F41B 5/10* (2013.01); *F41G 1/467* (2013.01)

(58) Field of Classification Search
CPC ..... F41B 5/10; F41B 5/1403; F41G 1/467
See application file for complete search history.

(56) References Cited

U.S. PATENT DOCUMENTS

| | | | | |
|---|---|---|---|---|
| 3,538,902 | A | | 11/1970 | Fowkes |
| 3,599,621 | A | | 8/1971 | Scrobell |
| 4,457,287 | A | | 7/1984 | Babington |
| 4,966,124 | A | | 10/1990 | Burling |
| 5,081,979 | A | | 1/1992 | Burling |
| 5,175,937 | A | * | 1/1993 | Emerson, III ..... 33/503 |
| 5,367,780 | A | | 11/1994 | Savage |
| 5,413,084 | A | | 5/1995 | Haggard |
| 5,651,354 | A | | 7/1997 | La Haise |
| 5,662,093 | A | * | 9/1997 | DenHerder ..... 124/23.1 |
| 5,842,460 | A | | 12/1998 | Barber |
| 6,988,495 | B1 | | 1/2006 | Van Hoorn |
| 7,708,004 | B2 | | 5/2010 | Moss et al. |
| 8,151,473 | B2 | | 4/2012 | Sims et al. |
| 2002/0073983 | A1 | | 6/2002 | Etheridge et al. |
| 2010/0018513 | A1 | | 1/2010 | Scaniffe |

* cited by examiner

*Primary Examiner* — John Ricci
(74) *Attorney, Agent, or Firm* — Gerald Carlson

(57) ABSTRACT

An archery bow has a handle pivotally attached to the riser. An indicator alerts the archer when the bow and handle are in proper alignment with reduced torque. Reduced bow torque results in improved accuracy.

20 Claims, 16 Drawing Sheets

ARCHERY BOW

CROSS REFERENCE TO RELATED APPLICATIONS

This application claims the benefit of the provisional application entitled "Archery Bow" by Daniel Ady, Ser. No. 61/833,054 filed on Jun. 10, 2013 and is hereby incorporated by reference in its entirety.

FEDERALLY SPONSORED RESEARCH OR DEVELOPMENT

Not applicable.

JOINT RESEARCH AGREEMENT

Not applicable

SEQUENCE LISTING

Not applicable

FIELD OF THE INVENTION

This invention relates generally to archery bows, and particularly to the reduction of torque on the bow handle while aiming at a target.

BACKGROUND OF THE INVENTION

Archery bows typically include a single riser (frame), two limbs, and a pair of pulleys, with at least one pulley having a cam surface to provide a mechanical advantage while "drawing back" and holding the poundage of the compound bow. This is typically what archers call "let off" which aides the archer if there is a situation when there needs to be an extended period of time of holding back the bow. Generally, 85% "let off" is the legal maximum allowed. "Torquing the bow" refers to twisting the bow about the axis of the riser. It is natural for an archer to torque the bow while aiming at a target. Generally located on the bowstring is a "kisser button". The purpose of the "kisser button" is to add another triangulation point of reference. Triangulation points include: the bow handle, kisser button, string touching tip of nose, looking through the peep sight and placing cable string in the middle of riser, or just having a perfect grip. Adding these methods together can make an archer more accurate. Generally, more triangulation points, equates to better accuracy. Even with all the reference points, the archer can still be inaccurate due to torquing the hand on the bow handle. By torquing the handle, less accuracy will be achieved, and will become exponential the further the target. From a beginner, to a pro, this problem seems to exist.

SUMMARY OF THE INVENTION

The embodiments described in this disclosure enable an archer to have an indicator that allows him or her to know when there is torque on the bow. No longer is "triangulation", or a "perfect grip" on the bow handle a catalyst for a "perfect shot". Unfortunately, the bows today have no way to remove a natural torque of the handle, or a way to know if the archer is doing this act. With all this happening, there needs to be an easier way to make the archer know when there is torque on the bow handle. The embodiments described in this disclosure provide an easier way to make the archer aware torque is happening. The embodiments described will allow the archer to become cognitive of when torque is being applied to the bow handle during the draw and aiming process. The embodiments will make the archer more accurate. It will take less time to become "pro" status. It will also make the bow hunter more accurate, and aid in harvesting game.

BRIEF DESCRIPTION OF THE DRAWINGS

The summary above, and the following description will be better understood in view of the enclosed figures which depict details of various embodiments. It should however be noted that the invention is not limited to the precise arrangement shown in the drawings and that the drawings are provided merely as examples. Like reference numerals refer to like parts.

DETAILED DESCRIPTION

Figure 1A:
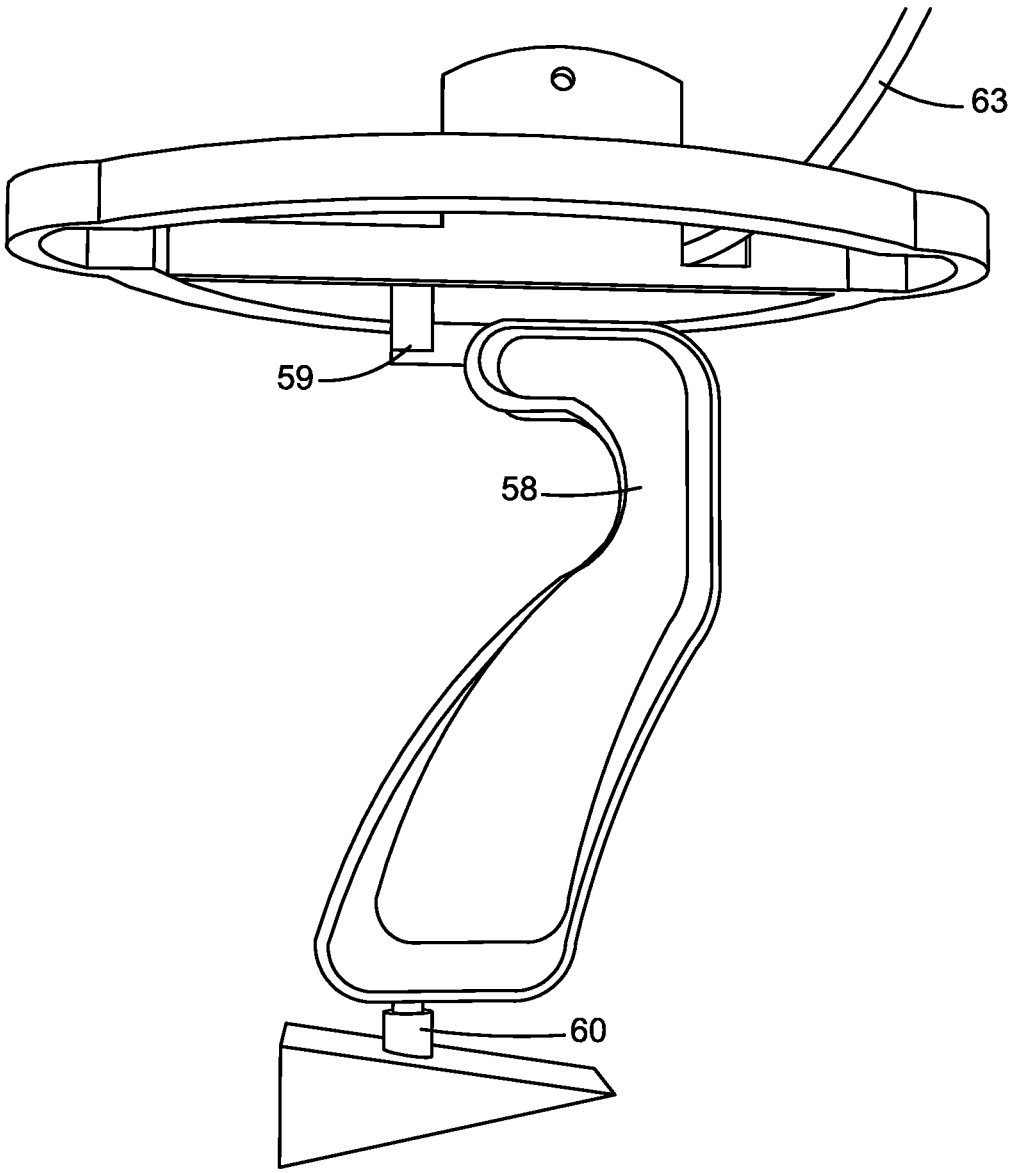
FIGS. 1A-1H show one embodiment of the archery bow handle with pivot capabilities.
Figure 1B:
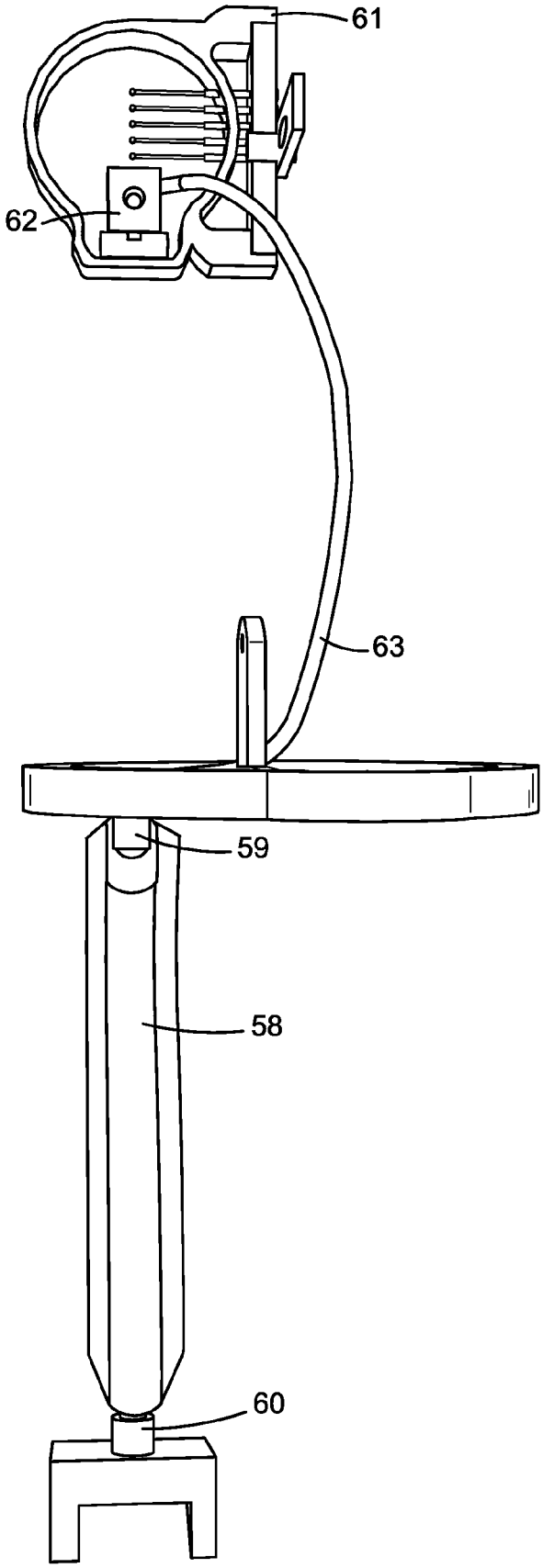
Figure 1C:
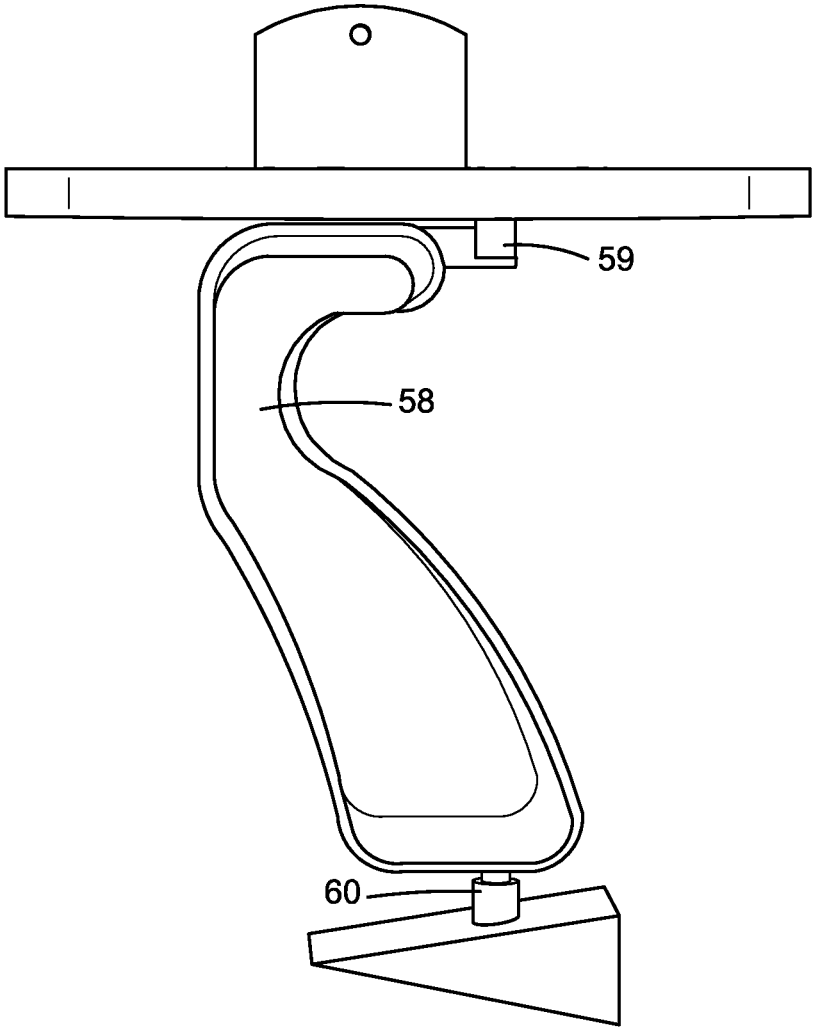
Figure 1D:
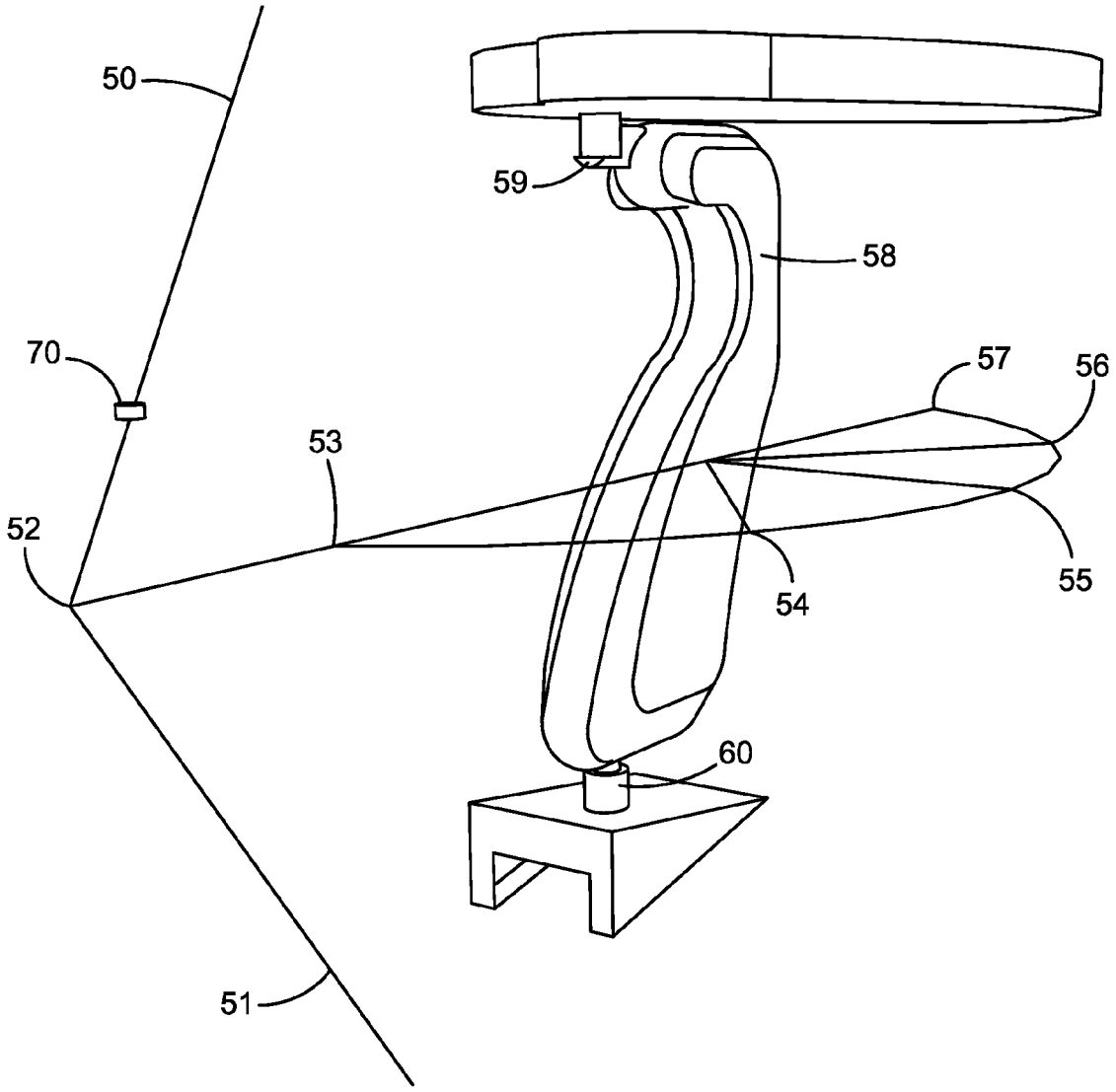
Figure 1E:
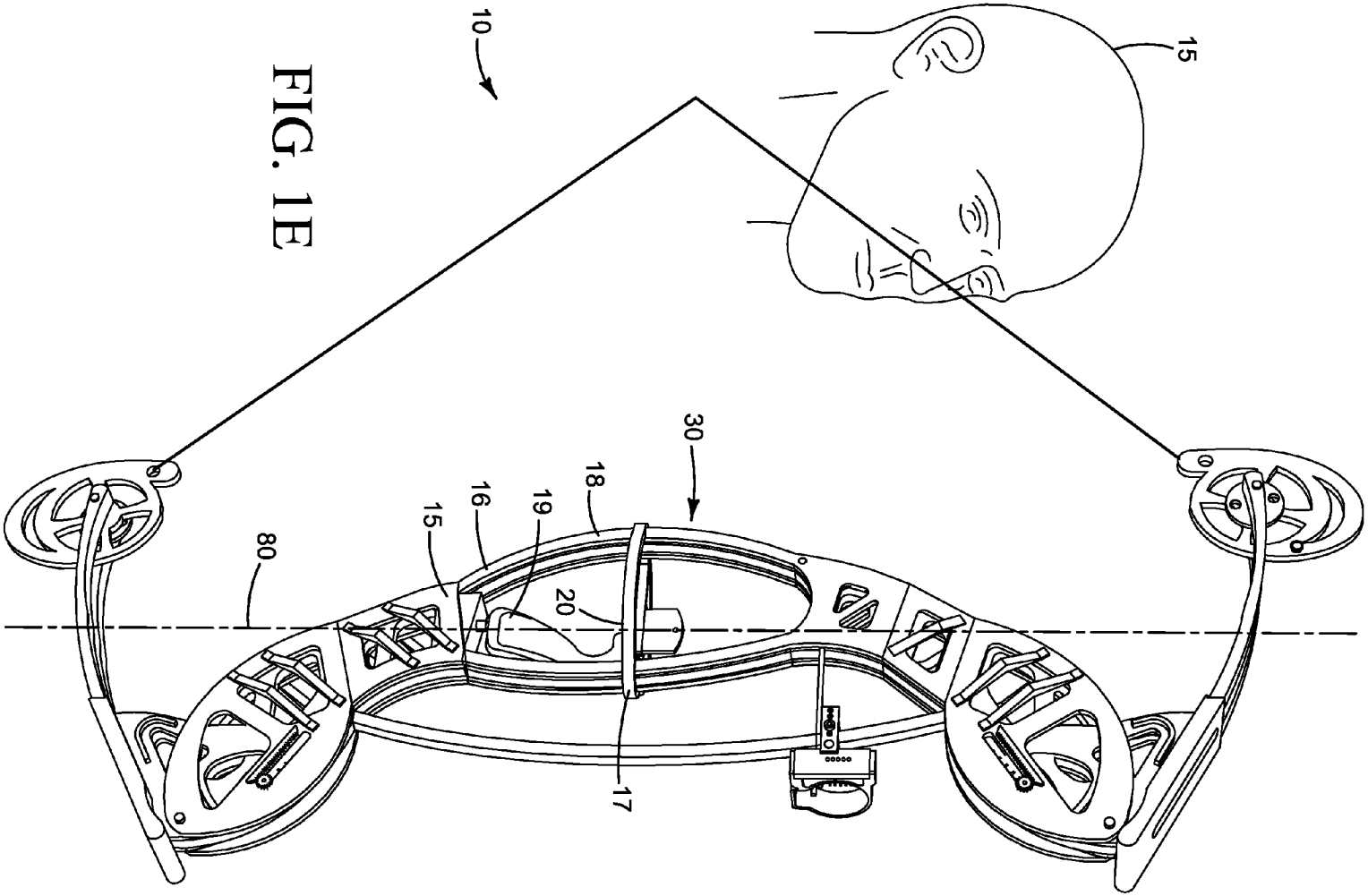

FIG. 1E shows an archery bow 10 and archer 15. FIG. 1E provides an overall context during the following detailed description of individual parts.

FIG. 1A shows a side view of the handle 58 for an archery bow. The handle 58 pivotally attaches to the riser (30 of FIG. 1E) of the bow with pivots 59, 60. The top and bottom pivots 59, 60 are behind the handle 58. In this disclosure the front of the bow is toward the target while the back of the bow is toward the archer. In other words, the handle 58 is more towards the target, or right side of FIG. 1A, while the top and bottom pivots 59, 60 are more towards the archer to the left of FIG. 1A. The purpose of having the top and bottom pivots 59, 60 behind the handle 58, is because the direct pressure is on the pivots 59, 60, and not the handle 58. While FIG. 1A shows a handle 58 with the pivots 59, 60 behind the handle 58, other embodiments have the handle 58 with the pivots 59, 60 in front of the handle 58.

FIG. 1B shows a perfectly aligned handle 58 with the top pivot 59, and bottom pivot 60 which allow handle 58 to move without any torque of the bow. Also depicted is a bow sight 61 that has a torque indicator 62, or simply indicator 62 located on the sight.

FIG. 1C is a close up side view of the handle 58 and the pivots 59, 60. As noted, the pivots 59, 60 are behind the handle 58 which lessens the probability of torque on the handle 58.

FIG. 1D shows a bow handle 58. References 50, 51 depict a bowstring at full draw. Reference 52 depicts the nock point where the nock of an arrow locates. The reference numbers 53, 54, 55, 56, and 57 show 45 degree increments which constitute a 180 degree, ½ protractor arc or half arc. The line between 53 and 57 indicates 180 degrees. For accuracy, the nock point 52, and points 53, and 57 should be in a line, or co-linear. As the handle 58 pivots about the axis of the bow, the nock point 52 will move into and out of alignment with points 53 and 57. The axis of the bow also called the riser axis, is an imaginary vertical line that extends through the riser from top to bottom of the bow. The axis 80 is shown in FIGS. 1E and 1G, while the riser 30 is shown in 1E. Best accuracy is achieved when the nock point 52 is aligned with points 53 and 57. Due to the pivots 59, 60 behind handle 58, this will relieve possible torque of the handle 58. With the pivots 59, 60 behind the handle 58, and the nock point 52 co-linear with 53 and 57, the arrow will hit the target with better accuracy. There will be no torque on the handle 58, and the nock point 52 will be in line to allow better accuracy. This condition is referred to as the desired alignment. The pivots 59, 60 behind the handle 58 will not affect the shot placement if there is some torque on the handle 58. In figures to follow, an indicator informs the archer that the nock point 52 is aligned with points 53 and 57, the desired alignment.

FIG. 1E shows the relation of the archery bow 10 to the archer 15 at full draw of the bow. The Axis 80 is depicted as a line that runs vertically through the handle 58 and riser 30.

Figure 1F:
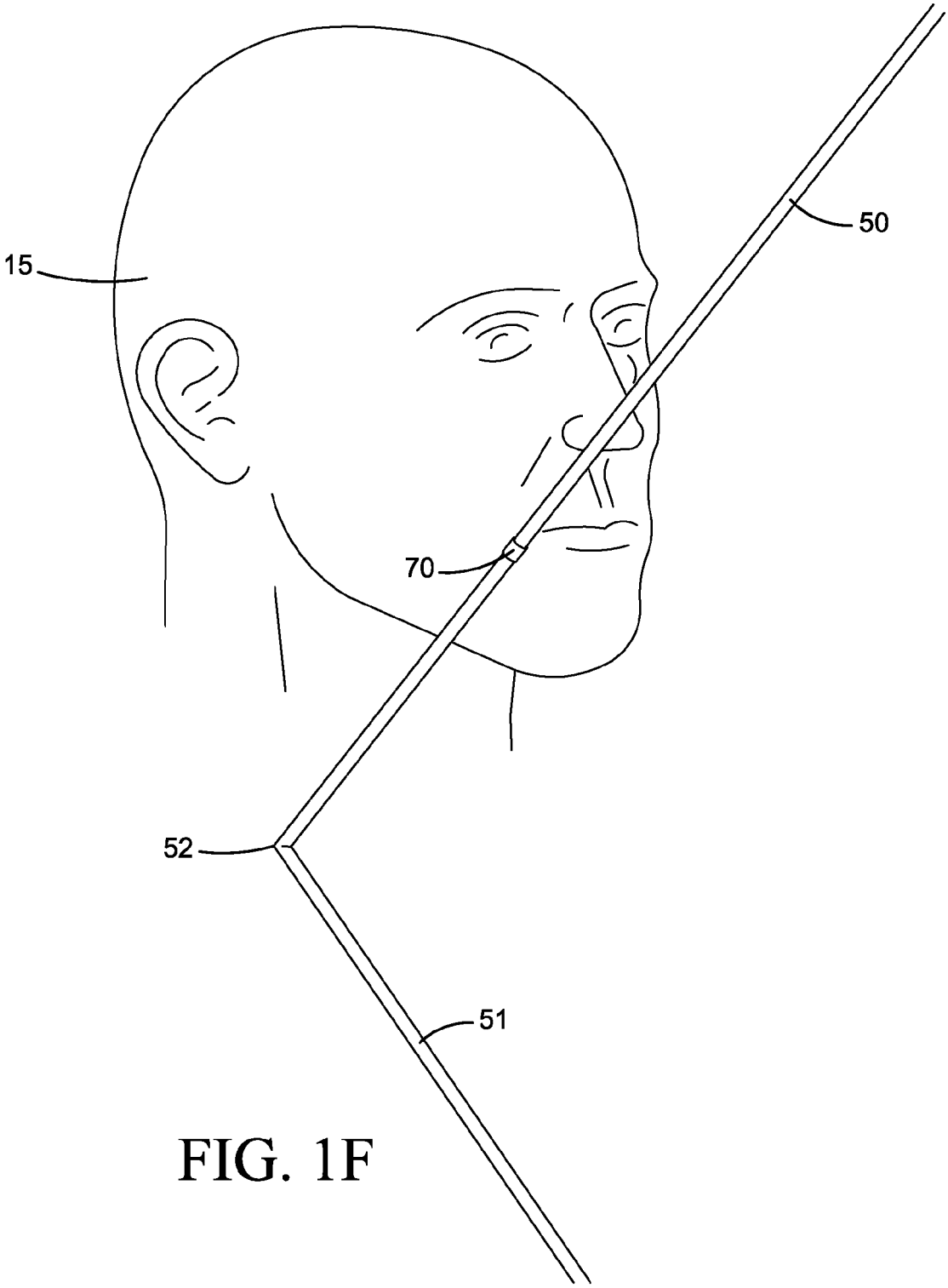
Figure 1G:
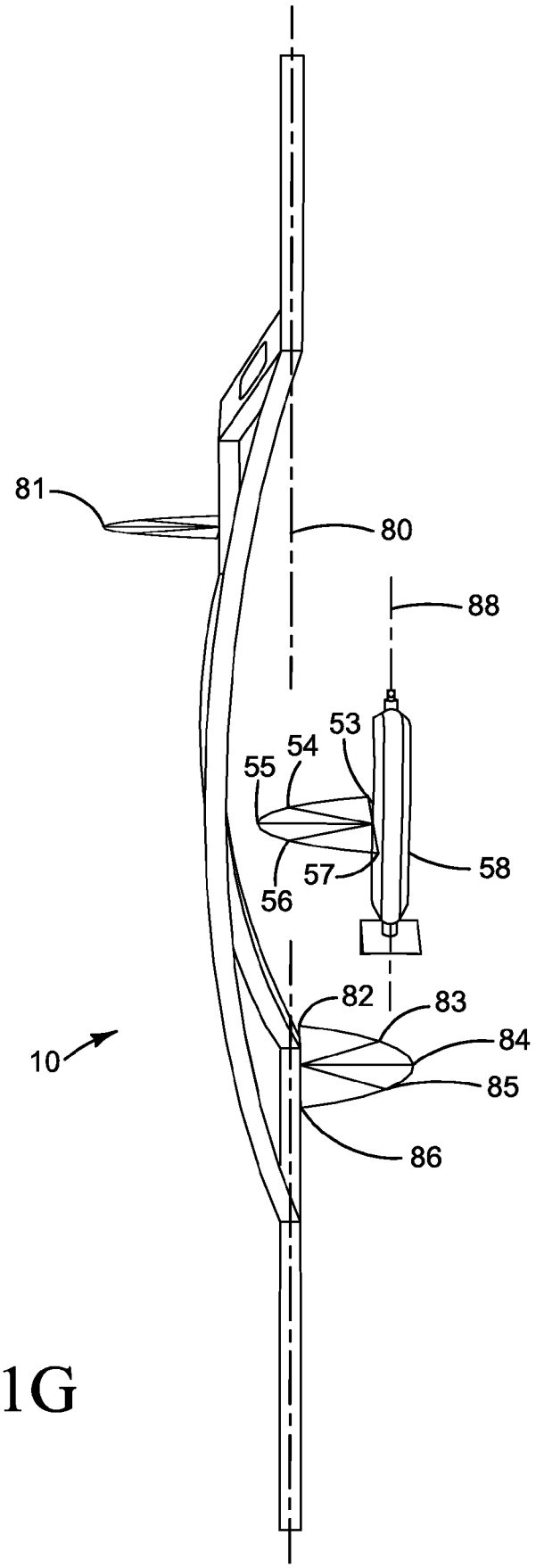

FIG. 1F shows the detail of the bow string segments 50 and 51 at full draw in relation to the archer 15. Note that the kisser button 70 is at the corner of the mouth of the archer 15. The nock point 52 is where the arrow (not shown) is fitted.

FIG. 1G shows a front view of the archery bow 10 with the handle 58 removed from the bow 10 for clarity. Dashed line 88 is the handle axis. In some embodiments the handle axis 88 coincides with the riser or bow axis 80, while in other embodiments the handle axis 88 is offset from the riser axis 80. Typically the handle axis 88 is substantially parallel to the riser axis 80. The half arcs 81 and 82 indicate the possible rotation of the bow 10, about the riser axis 80 with respect to the handle 58.

Figure 1H:
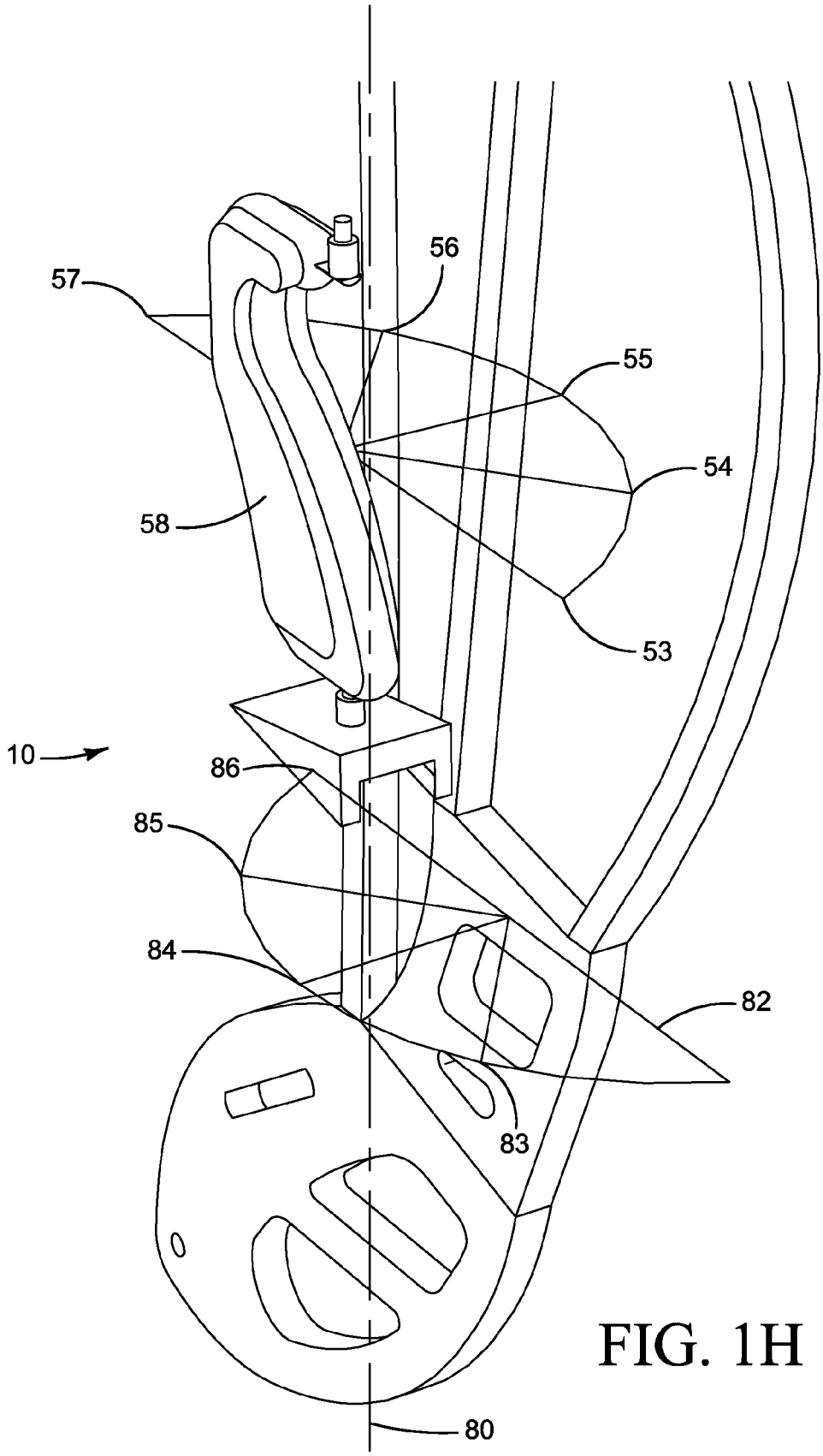

FIG. 1H shows in more details 53, 54, 55, 56, 57of the half arcs associated with the handle 58 and the details 82, 83, 84, 85, 86 of the half arcs associated with the bow 10. When the line segment indicated by 53 and 57 is coplanar with the line segment between 82 and 86, there is reduced torque on the bow 10.

Figure 2A:
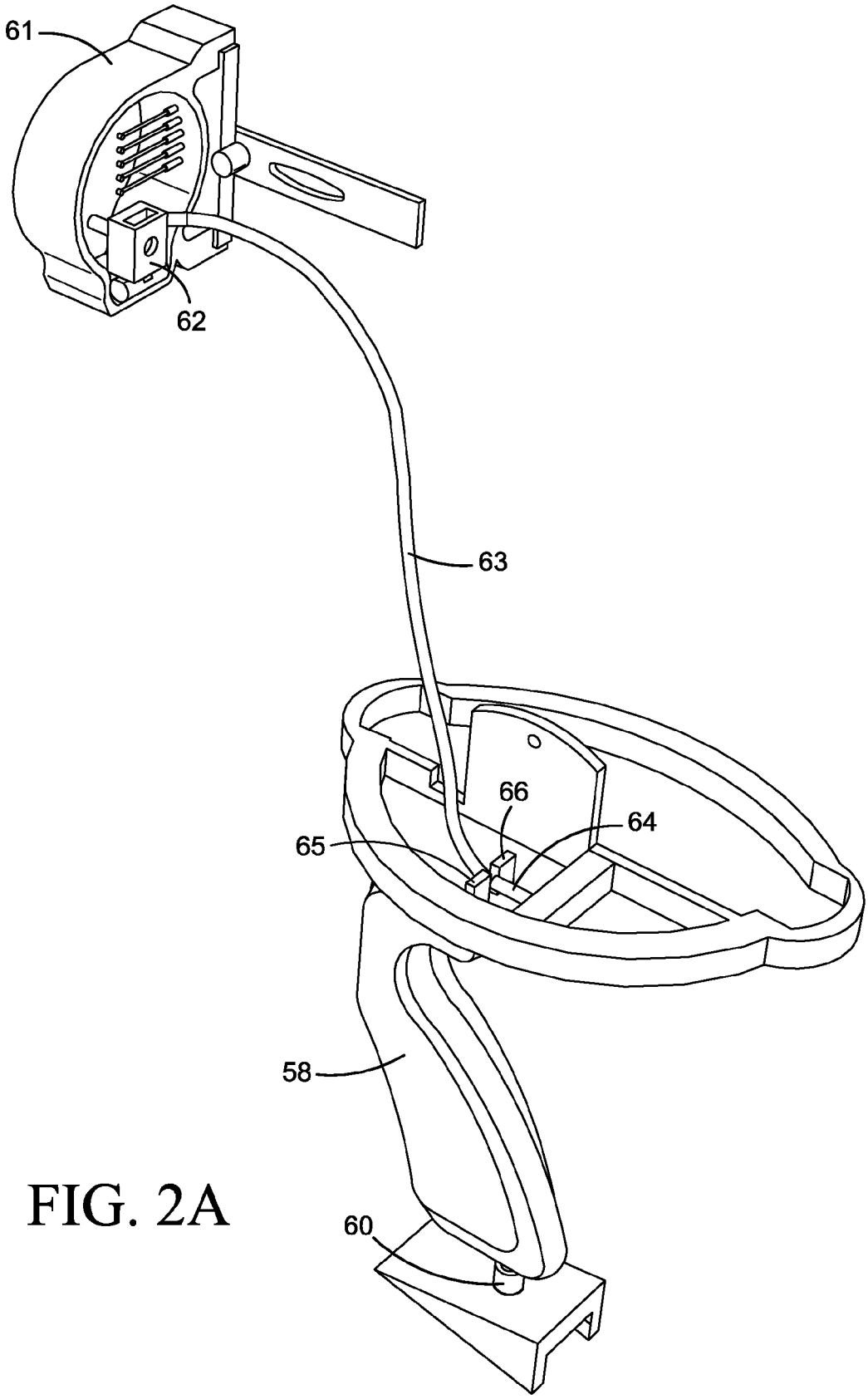
FIGS. 2A-B show an embodiment of a torque indicator located above the handle and ending at the sight.
Figure 2B:
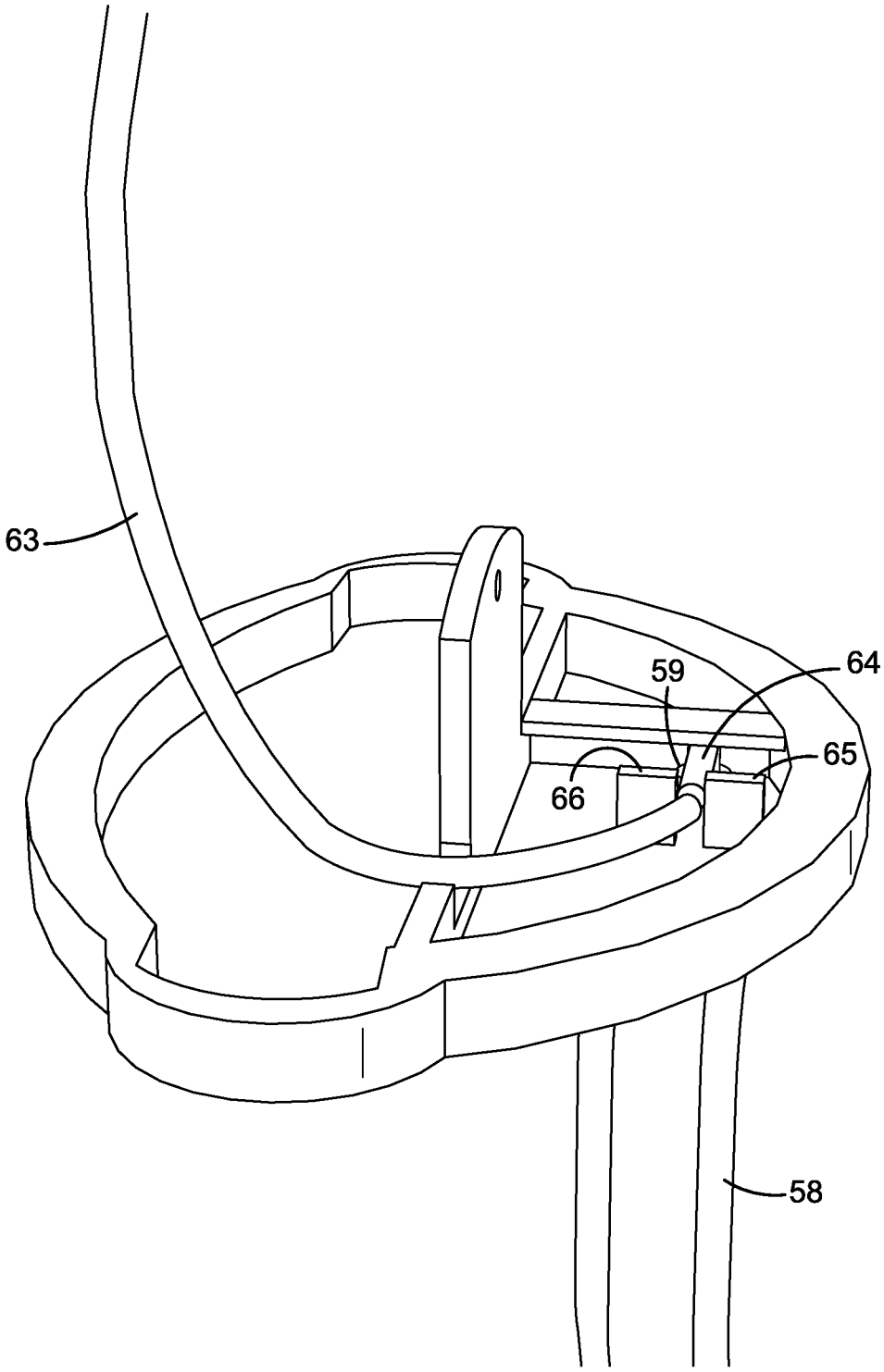

FIG. 2A shows a bow handle 58 with a torque indicator or simply indicator 62 located on the sight 61. A receiver 63 connects the indicator 62 and two posts 65, 66. The receiver 63 can have different types of cores such as metal, magnetic materials, electrical, or optically conducting cores. In the embodiments of FIGS. 2A-2B, the receiver 63 is metal, particularly ferromagnetic since it is strongly attracted to a magnet. Posts 65, 66 are non-magnetic material.

FIG. 2B shows the mechanical means by which an emitter 64 is used to indicate the desired alignment of the 52 nock point with points 53 and 57 of FIG. 1D. In this embodiment, the emitter 64 is a magnetic system. Attached to pivots 59, 60 or handle 58 is a strong magnet such as a neodymium iron boron earth magnet 64. Posts 65 and 66 are non-magnetic. When the archer puts their hand on the bow handle 58, and draws the bow, and then places the "kisser button" 70 on the corner of the mouth, the torque indicator 62 will let the archer know if the "kisser button" 70 is at the correct degree for improved accuracy. If the archer is at an angle and his/her head is tilted and the "kisser button" 70 is correctly in the corner of the mouth, and yet the indicator 62 is indicating "torque" on the bow, the archer should not release the arrow. If the archer watches for the indicator 62 to actuate, the nock point 52 is aligned with points 53 and 57 of FIG. 1D, then the arrow should be released for improved arrow placement. As the handle 58 turns about pivots 59 and 60; the emitter 64, attached to the handle 58 pivots with the handle and moves left and right. Once the emitter 64 is between the posts 65, 66 post, the emitter magnet will be attracted to the receiver 63. Consequently the receiver 63 is responsive to the emitter 64 when the desired alignment for an accurate shot is achieved.

Figure 3A:
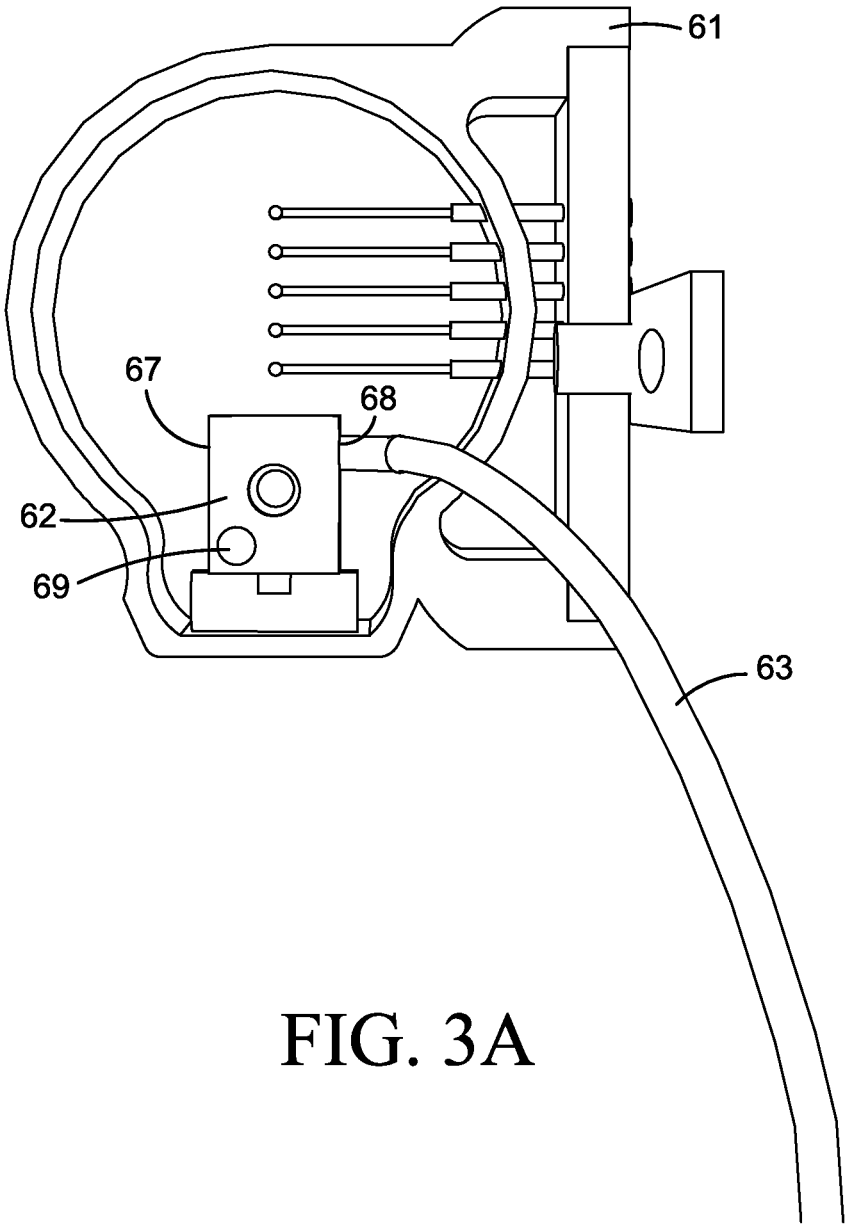
FIGS. 3A-3E show embodiments of the torque indicator.

Thus, when the nock point 52 is in alignment with points 53 and 57 of FIG. 1D, the emitter magnet 64 attracts and activates the receiver 63. The receiver 63 as shown in FIG. 3A is responsive to the emitter 64 and moves the indicator 62 comprised of a metal movable shield 69 revealing icon 67. When the icon 67 is revealed, it indicates to or alerts the archer that the bow 10 is not torqued and is thus ready to release. In summary, the embodiments of FIGS. 2A and 2B, use a magnetic material as a receiver 63. When the magnetic emitter 64 aligns with the receiver 63, the receiver 63 will conduct the magnetic flux of the emitter 64 to actuate the shield 69 on the indicator 62 revealing the icon 67. Generally stated, the indicator 62, is responsive to the receiver 63, while the receiver 63 is responsive to the emitter 64 when the riser 30 and handle 58 are in a desired alignment for an accurate shot. In this disclosure, the term icon means an indication or alert to the archer that the indicator 62 is actuated. The indication described is visual but other indications such as tactile or audible are also possible.

FIG. 3A shows an indicator 62 on a bow sight 61, letting the archer 15 know that the desired alignment is met and the bow 10 is ready to shoot. When emitter 64 is placed directly between the two non-magnetic posts 55, 56, this will send a magnetic pull to the end of the receiver 63 and its metal core. Once the magnet 64 is aligned with the receiver 63, it will pull up the metal shield 69 above the icon 67. Icon 67 will always be covered until the metal shield 69 is lifted above the icon 67. If the handle 58 is not at the correct angle, then the metal shield 69 will drop back down by gravity or spring force until the magnetic force of emitter magnet 64 activates it again. For those s states which do not allow anything electrical on a bow or an arrow, this magnetic system is used. Other embodiments use electrical components to activate an indicator notifying the archer to shoot. One embodiment uses an optical conductor such as fiber optics in the receiver 63 instead of magnetic metal. A light emitting device such as a light emitting diode, hereafter referred to as an LED, or laser placed on the handle 58 works on the same principle as the magnetic system previously discussed. Once the light is between the posts 65, 66, it shines a beam into the optical conductor and illuminates the indicator 62 at end of the optical conductor letting the archer know there was no torque on the handle, and the desired alignment has been achieved, and now to release the arrow. In the place of an LED light, a laser beam serves the same purpose. Still another embodiment uses the magnet emitter 64 on the pivot point 59 or handle 58. Once the magnet emitter 64 is directly in front of the receiver 63, then a magnetic switch receiver 63 could activate a LED light on the torque indicator 62. Whatever embodiment is chosen, it is derived from the handle being able to pivot, and the "kisser button" placed in alignment with points 53 and 57 of FIG. 1D. The indicator 62 in its various embodiments is responsive to the receiver 63 in its various embodiments, which in turn is responsive to emitter 64 in its various embodiments. Additionally, while the indicator 62 is depicted in the figures as located on the bow sight 61, other locations such as the riser 30 are also possible.

Figure 3B:
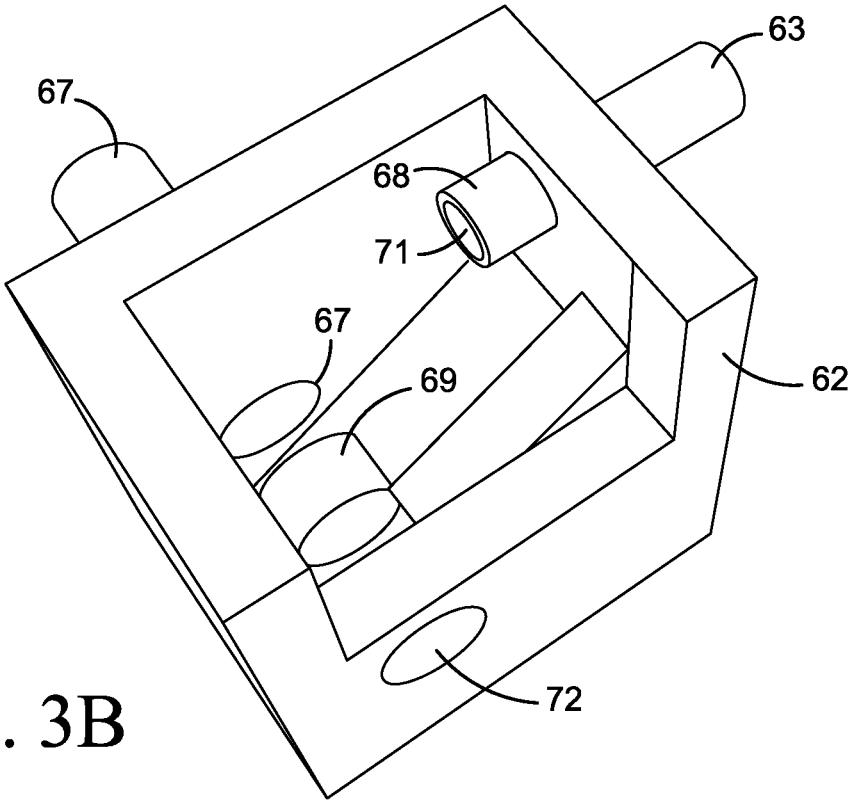

FIG. 3B shows a top view of torque indicator 62, A shield 69 rests at the base of torque indicator 62. As an archer looks through a hole 72 located in the front of the torque indicator 62, the shield 69 will impair the view of the icon 67. As the bow handle 58 FIG. 1D is turned and the emitter magnet 64 locates between posts 65 and 66 of FIG. 2A, the emitter magnetic 64 activates the end 68 of the receiver 63. The shield 69 will be attracted to this pull and lift until it is in contact with the receiver end 71. It will remain attached to end of receiver 68 until handle 58 is turned out of alignment thus turning off the magnetic pull. The icon 67 can take many embodiments including inner and outer cores of acrylic filled with edge glow. The inner core will have a higher index while the out core will have a lower index. Ultra violet rays will activate edge glow within the core causing the icon 67 to be very visible to the archer. The shield 69 when relaxed at the bottom of torque indicator 62, will hide the icon 67.

Figure 3C:
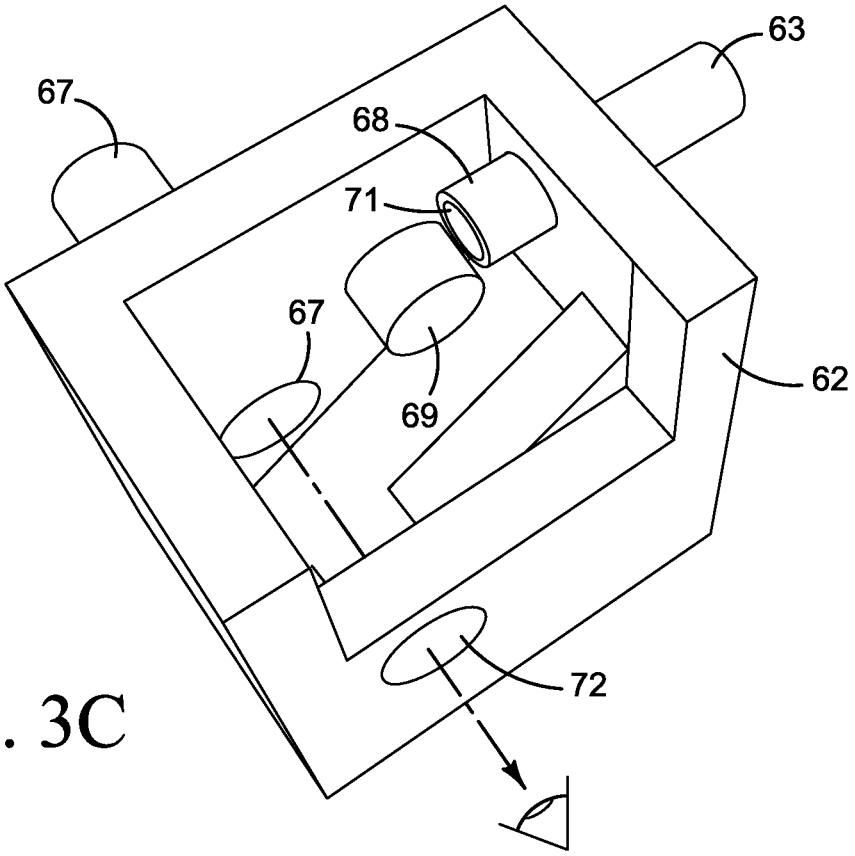

FIG. 3C shows the shield 69 attracted to receiver end 68, exposing end of icon 67. Now archer can look through hole 72 in front of torque indicator 62, and see icon 67, which would give notice to the archer to release the arrow.

Figure 3D:
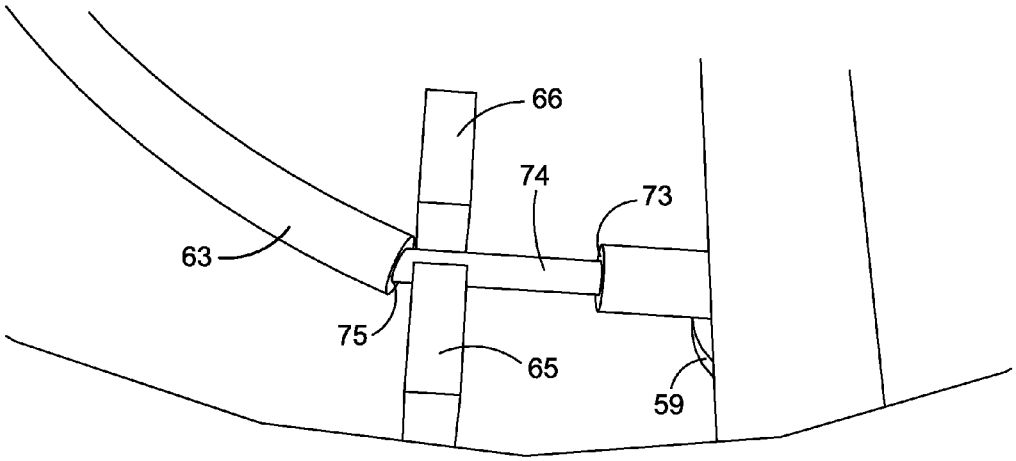

FIG. 3D shows an embodiment where the emitter 64 of FIGS. 2A and 2B is an LED or laser 73 attached to pivot hardware 59, 60 or handle 58. As the handle 58 of FIG. 1D turns pivot 59, laser or LED 73 emits a beam of light 74 between posts 65 and 66. The beam of light 74 will hit the receiver 63, which in this embodiment is an optical conductor 75. The light will travel through the optical conductor 75 until it illuminates the end of the optical conductor at the torque indicator 62. When the end of the optical conductor at the torque indicator 62 is illuminated, it signals the archer to release the arrow. In this embodiment, the receiver 63 is one end of the optical conductor 75, while the indicator 62 and icon 67 are the opposite or second end of the same optical conductor 75. This embodiment is suitable in jurisdictions where electronics are allowed on archery bows. The optical conductor can take a number of forms such as molded plastic, optical fibers, or reflective paths. In some embodiments, the light emitting device 73 is located other than on the handle 58 and the handle 58 includes a reflector to reflect light 74 from the light emitting device 73 to the receiver 63 when the desired alignment is achieved. In this embodiment, the emitter is a reflector.

Figure 3E:
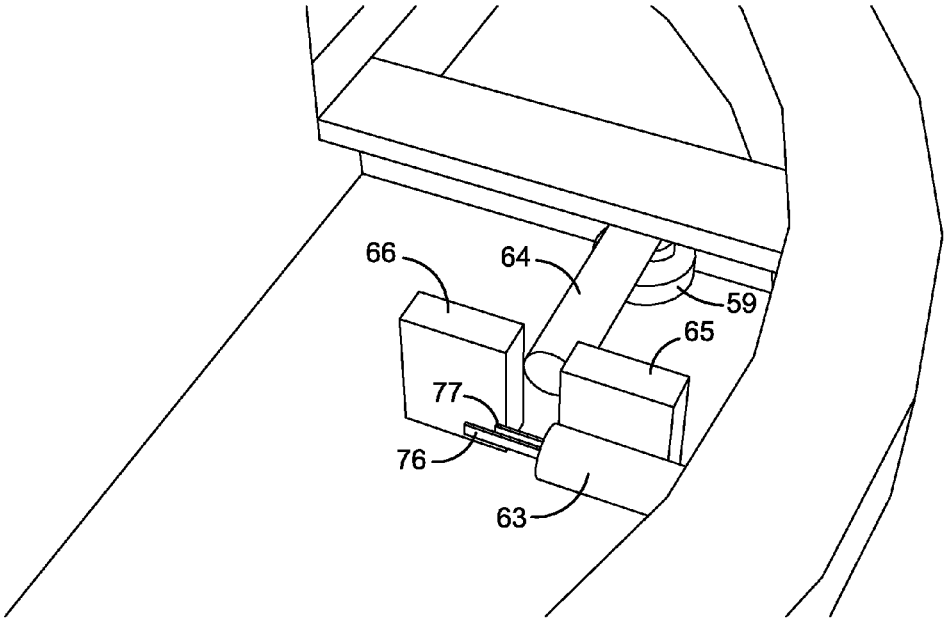

FIG. 3E shows yet another embodiment where the receiver 63 of FIGS. 3A and 3B is now a magnetic switch 76-77 which is responsive to an emitter magnet 64. When magnet 64 pivots between posts 65 and 66, it activates magnetic switch 76-77. This completes an electrical circuit which activates an electrically activate-able light emitting device 73 such as an LED. In this embodiment the LED circuit is both the indicator 62 and icon 67 of FIGS. 3A and 3B. Handle 58 of FIG. 1D pivots about pivot 59 or 60, which move magnet emitter 64, which in turn lines up between non magnetic posts 65 and 66. Magnet emitter 64 activates switch 76-77, closing the electrical circuit causing the light emitting device 73 to illuminate, giving notice to the archer to release the arrow.

Figure 4:
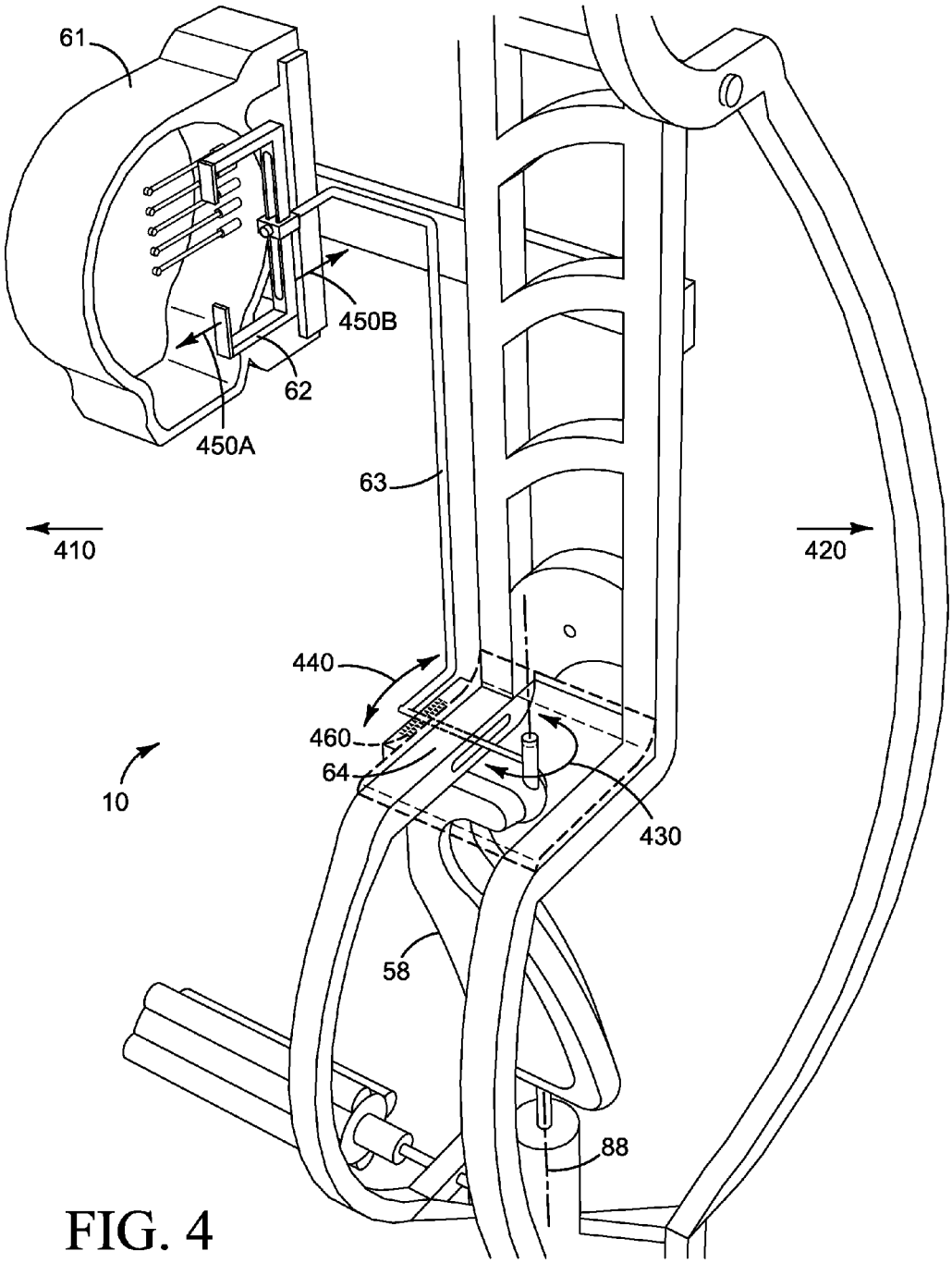
FIG. 4 shows another embodiment of the torque indicator.

FIG. 4 shows still another embodiment of the archery bow 10. In FIG. 4 arrow 410 is at the bow front and points to toward the target, while arrow 420 is at the bow back and points toward the archer. As described in conjunction with FIG. 1G, the handle has a handle axis 88 and the riser has a riser axis 80. In this embodiment, the handle axis 88 is substantially parallel to the riser axis 80 of FIG. 1G. In FIG. 4, the emitter 64, receiver 63, and indictor 62 are mechanically connected. They may be one piece or a collection of pieces connected together. The emitter 64 attaches to the handle 58 or one of the pivots 59, 60 and pivots about the handle axis 88 as indicated by arcs 430 and 440. The receiver 63 is responsive to the emitter 64 and moves with the emitter 64. The indicator 62 is responsive to the receiver 63 and moves with the receiver 63. The indictor movement is indicated by arrows 450A and 450B. When the desired alignment is achieved for a more accurate shot, the indicator 62, by its position, indicates to, or alerts the archer to release the arrow. As the handle 58 pivots about the handle axis 88, the position of desired alignment is that which provides the more accurate shot. The indicator 62 can operate independently or in cooperation with a bow sight 61. This embodiment is mechanical in nature, and can be implemented with or without magnetic or electric devices. Some versions of this embodiment use materials that are adjustable so that the bow can be sighted in to have the indicator 62 adjusted for the best desired alignment.

FIG. 4 shows the emitter 64 passing between two bias springs 460. These springs 460 exert force on the emitter 64 urging the handle to naturally come to the desired alignment for a more accurate shot. In some embodiments, these springs 460 are adjustable so the handle 58 has the least amount of torque when the desired alignment is achieved. The embodiment of FIG. 4 shows two bias springs 460 acting against each other, one on either side of the emitter 64. Other versions of the springs 460 can use torsion springs in the handle 58 itself. During the sighting in of the bow 10, the archer adjusts either type of bias springs 460 to aid setting the handle 58 to the desired alignment for a more accurate shot.

Figure 5:
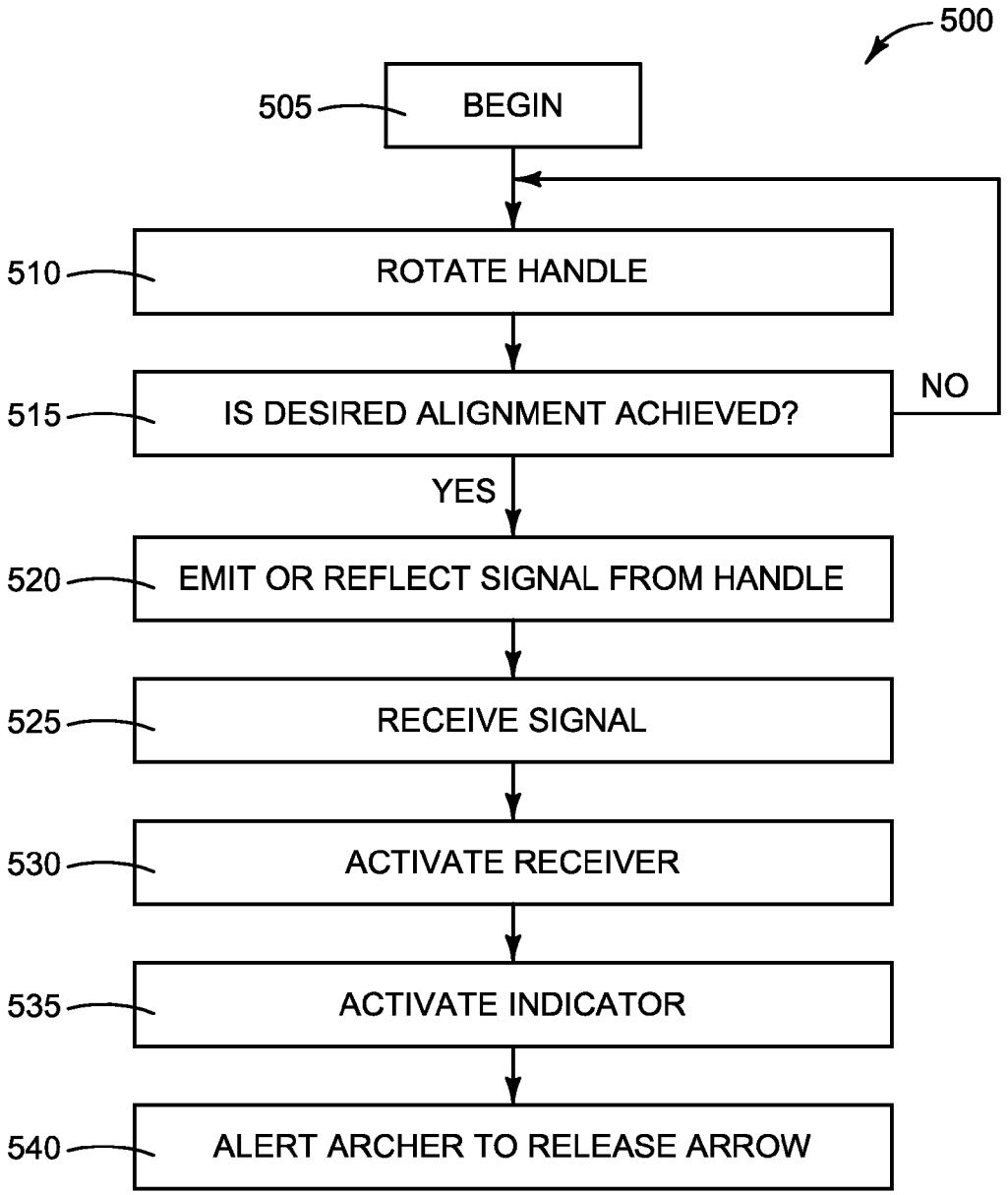
FIG. 5 shows embodiments of a method for reducing torque prior to a shot

The use and operation of the bow can be expressed as a method 500 as shown in FIG. 5. The procedure begins at block 505. This procedure is useful both in accurate shooting and in setting up a bow for more accuracy. In block 510 the handle is rotated about the handle axis. At block 515 when desired alignment is achieved, the emitter, in its various forms activates a signal, be it mechanical, magnetic or electrical at block 520. If the desired alignment is not achieved, the archer continues to rotate the handle returning to block 510. When the desired alignment is achieved, the emitter emits a signal at 520. the signal is received by the receiver at 525 at activates the receiver at 530. This activation varies depending upon the particular embodiment of the emitter, receiver and indicator as described previously. When the indicator actives at 535 it alerts the archer that the desired alignment is achieved. At this point the archer should release the arrow for a more accurate shot.

Figure 6A:
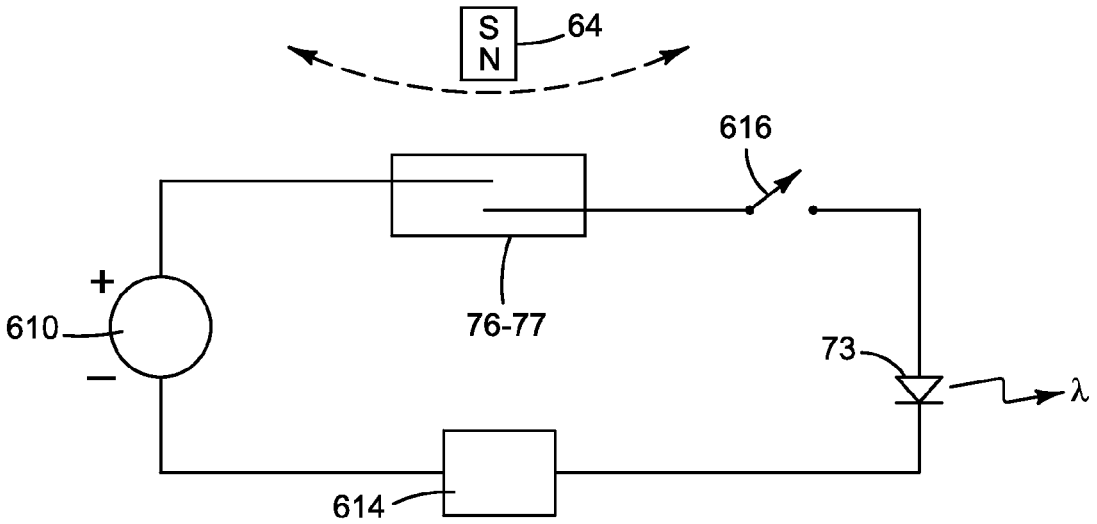
FIGS. 6A-6B show embodiments of the electrical circuitry for a light emitting device.
Figure 6B:
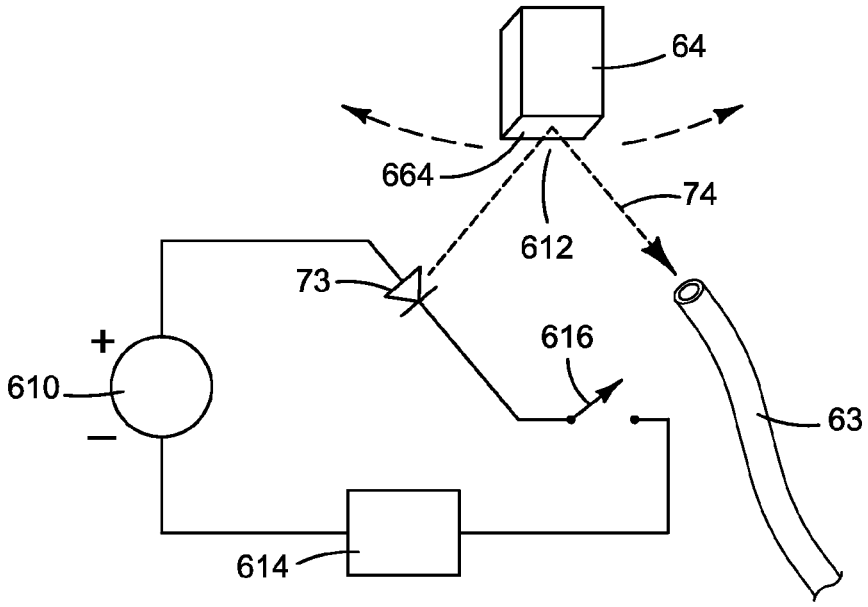

FIGS. 6A and 6B show electrical circuits for electrical embodiments of the archery bow. In FIG. 6A the light emitting device 73 is responsive to the magnetic switch 76-77 and the electric source 610. In FIGS. 6A and 6B electrical source 610 such as a battery or cell supplies electrical power to a light emitting device 73 such as an LED, laser, or light bulb. This connection is made through a series connection of one or more switches such as magnetic switch 76-77, and off-on switch 614. A current control 614 is also used in situations where the current to the light emitting device must be regulated. In the embodiment of FIG. 6A the emitter magnet 64, activates the magnetic switch 76-77 when the handle and emitter 64 are in the desired alignment for an accurate shot.

FIG. 6B shows a similar connection of electric source 610, light emitting device 73, off-on switch 616 and current control 614. In the embodiment of FIG. 6B the light from the light emitting device 73 is reflected off of a reflecting surface 664 located on the emitter 64. When the emitter 64 pivots into the desired alignment light beam 74 reflects into the receiver 63. In both FIG. 6, the arc bath of the emitter 64 indicates the rotation or pivot of the emitter 64 as the handle 58 turns about the handle axis 88.

It will be appreciated that the invention is not limited to what has been described hereinabove merely by way of example. The listing of specific materials or methods in this disclosure are provided merely by way of illustration, and not limitation. While there have been described what are at present considered to be the preferred embodiments of this invention, it will be obvious to those skilled in the art that various other embodiments, changes, and modifications may be made therein without departing from the spirit or scope of this invention and that it is, therefore, aimed to cover all such changes and modifications as fall within the true spirit and scope of the appended claims.

Glossary

| Ref. # | Description |
|---|---|
| 10 | Archery bow |
| 15 | Archer |
| 30 | Riser |
| 50 | Top segment of bowstring above nock point |
| 51 | Bottom segment of bowstring below nock point |
| 52 | Nock point where arrow nock mates |
| 53 | End point of line perpendicular w/ riser & 180 degree plane |
| 54 | A 45 degree mark from handle |
| 55 | A 45 degree mark from handle |
| 56 | A 45 degree mark from handle |
| 57 | End point of line perpendicular w/ riser & 180 degree plane |
| 58 | Bow handle or handle |
| 59 | Top pivot |
| 60 | Bottom pivot |
| 61 | Bow sight |
| 62 | Torque indicator, or indicator |
| 63 | Receiver such as a tube containing ferrous metal, wires, or fiber optics. |
| 64 | Emitter including, but not limited to a magnet, laser, LED, mechanical element, or reflector. |
| 65 | Non-magnetic post |
| 66 | Non-magnetic post |
| 67 | High Visible Optic also called an icon |
| 68 | Receiver end |
| 69 | Metal shield |
| 70 | Kisser button |
| 71 | Magnetic Receiver End |
| 72 | Hole |
| 73 | Light emitting device such as an LED, bulb or laser |
| 74 | Light Beam |
| 75 | Optical conductor such as Fiber optic Core |
| 76-77 | Magnetic switch |
| 80 | Axis of the bow/riser |
| 81 | Half arc on bow |
| 82 | Half arc on bow |
| 83 | 45 degree mark from bow |
| 84 | 45 degree mark from bow |
| 85 | 45 degree mark from bow |
| 86 | 45 degree mark from bow |
| 88 | Handle axis |
| 460 | Adjustable bias springs configured to urge the handle. |
| 410 | Bow front |
| 420 | Bow back |
| 430 | Handle pivot/rotation |
| 440 | Emitter pivot/rotation |
| 450A/B | Indicator movement |
| 460 | Adjustable bias springs |
| 500 | Method |
| 505 | Start of Method |
| 510 | Rotating the Handle |
| 515 | Determining a Desired Alignment |
| 520 | Emitting or Reflect a Signal from the Handle |
| 525 | Receiving the Signal |
| 530 | Activating the Receiver |
| 535 | Activating an Indicator |
| 540 | Alerting the Archer |
| 610 | Electric Source |
| 612 | Reflector |
| 614 | Current control |
| 616 | Off-On Switch |
| 664 | Reflective surface |

I claim:

1. An archery bow comprising:

a riser having an axis;

a handle pivotally attached to the riser;

an emitter attached to the handle, the emitter pivotable with the handle;

a receiver attached to the riser, the receiver responsive to the emitter when the emitter and receiver are in a desired alignment; and an indicator responsive to the receiver when the receiver and emitter are in the desired alignment.

2. The archery bow of claim 1 wherein the emitter is a magnet.

3. The archery bow of claim 2 wherein the receiver is a magnetic switch responsive to the magnet.

4. The archery bow of claim 3 wherein the indicator is a light emitting device responsive to the magnetic switch and an electric source.

5. The archery bow of claim 1 wherein the receiver is a magnetic material responsive to the emitter.

6. The archery bow of claim 5 wherein the indicator further comprises a shield responsive to the receiver.

7. The archery bow of claim 1 wherein the emitter is a light emitting device.

8. The archery bow of claim 1 wherein the receiver is an optical conductor having two ends, one end being the receiver and the other end being the indicator.

9. The archery bow of claim 1 further comprising one or more bias springs, the bias springs configured to urge the handle to the desired alignment.

10. An archery bow having a bow front toward a target and a bow back toward an archer the archery bow comprising:

a riser having a riser axis;

a handle pivotally attached to the riser, the handle, having a handle axis, the handle axis substantially parallel to the riser axis;

an emitter, the emitter pivotable with the handle, substantially about the handle axis;

a receiver responsive to the emitter when the handle achieves a desired alignment as the handle pivots about the handle axis; and an indicator responsive to the receiver when the desired alignment is achieved.

11. The archery bow of claim 10 wherein the emitter is a light emitting device.

12. The archery bow of claim 10 wherein the receiver is an optical conductor having two ends, one end being the receiver and the other end being the indicator.

13. The archery bow of claim 10 wherein the emitter is a magnet and the receiver is a magnetic switch responsive to the magnet connecting a light emitting device to an electric source.

14. The archery bow of claim 10 wherein the indicator is a light emitting device, the emitter is a magnet and the receiver is a magnetic switch responsive to the magnet, the receiver configured to connect the light emitting device to an electric source.

15. The archery bow of claim 10 wherein the handle axis is offset from the riser axis.

16. The archery bow of claim 10 further comprising pivots, pivotally connecting the handle to the riser, the pivots located behind the handle.

17. The archery bow of claim 10 further comprising an adjustable spring bias, the adjustable spring bias urging the handle to the desired alignment.

18. The archery bow of claim 10 further comprising top and bottom pivots 59, 60 on handle 58 pivotally connecting the handle to the riser 30.

19. The archery bow of claim 10 further comprising a plurality of bias springs, the bias springs configured to urge the handle to the desired alignment.

20. A method for reducing torque error of an archery bow, when used by an archer, the archery bow having a handle and a riser, the method comprising:

rotating the handle relative to the riser;

determining a desired alignment between the handle and riser for reduced torque error;

emitting a signal from the handle;

receiving the signal;

activating a receiver by the emitter when the desired alignment is achieved;

activating an indicator by the receiver when the desired alignment is achieved;

alerting the archer by the indicator when the desired alignment is achieved.

* * * * *